US006742455B2

(12) United States Patent
Fukui

(10) Patent No.: US 6,742,455 B2
(45) Date of Patent: Jun. 1, 2004

(54) METHOD FOR HOLDING SHEET MATERIAL, AND IMAGE RECORDING APPARATUS

(75) Inventor: Takashi Fukui, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/225,394

(22) Filed: Aug. 22, 2002

(65) Prior Publication Data

US 2003/0037688 A1 Feb. 27, 2003

(30) Foreign Application Priority Data

Aug. 23, 2001 (JP) ..... 2001-252739

(51) Int. Cl.[7] ..... B41F 27/12

(52) U.S. Cl. ..... 101/477; 101/415.1; 271/82; 271/277

(58) Field of Search ..... 101/378, 409, 101/415.1, 477; 271/82, 277; 355/75, 85, 110

(56) References Cited

U.S. PATENT DOCUMENTS 6,260,482 B1 * 7/2001 Halup et al. ..... 101/477
6,418,849 B1 * 7/2002 Fukui ..... 101/409
6,457,410 B1 * 10/2002 Zerillo ..... 101/389.1

FOREIGN PATENT DOCUMENTS

JP 2003-66617 * 3/2003

* cited by examiner

*Primary Examiner*—Leslie J. Evanisko
(74) *Attorney, Agent, or Firm*—Sughrue Mion, PLLC

(57) ABSTRACT

A method for holding a sheet material wound around a circumferential surface of a rotating drum and an image recording apparatus are provided. When at least one of a leading edge and a trailing edge of the sheet material, which is fed in a direction tangential to the rotating drum, is nipped between the circumferential surface of the rotating drum and chucks, nipping by the chucks is sequentially effected from one axial-direction end of the rotating drum to the other axial-direction end of the rotating drum.

22 Claims, 4 Drawing Sheets

METHOD FOR HOLDING SHEET MATERIAL, AND IMAGE RECORDING APPARATUS

BACKGROUND OF THE INVENTION

1. Field of the Invention

The present invention relates to a method for holding a sheet material wound around a circumferential surface of a rotating drum. The invention further relates to an image recording apparatus disposed with a rotating drum around which a sheet-like recording material can be wound, with an image being recorded on the recording material wound around the rotating drum while the rotating drum and a recording section disposed in correspondence to the circumferential surface of the rotating drum are relatively moved.

2. Description of the Related Art

Technology has been developed in which, using a sheet-like recording material, and particularly a printing plate precursor including a photosensitive layer formed on a substrate, an image is recorded directly with a laser beam or the like on the photosensitive layer (an emulsion surface) of the printing plate precursor (printing plate exposure apparatuses). With such technology, images can be rapidly recorded on printing plate precursors.

In an automatic printing plate exposure apparatus using such technology for recording an image on a printing plate precursor, the image is recorded on the printing plate precursor wound around a circumferential surface of a rotating drum, while the drum is rotated at a high-speed (main scanning) and an exposure head is moved along an axial direction of the rotating drum (sub scanning).

Among this type of automatic printing plate exposure apparatus, an apparatus is known in which one end of the printing plate precursor is clamped onto the rotating drum by a clamp mechanism including an open-close chuck that is fixed or removably disposed at the rotating drum.

The clamp mechanism holds the printing plate precursor to the rotating drum by first opening the chuck (to create a space between the chuck and the rotating drum) to allow the printing plate precursor to be fed onto the rotating drum from a direction tangential to the rotating drum and then closing the chuck (to thereby nip the printing plate precursor between the chuck and the rotating drum) when the fed printing plate precursor has been registered at a predetermined position.

However, slack, resulting from waves or curls already present in the printing plate precursor prior to the printing plate precursor being nipped against the rotating drum, is sometimes generated when the printing plate precursor is nipped, due to the chuck simultaneously closing across the width direction of the printing plate precursor. This leads to degradation of image quality, because the accuracy with which the printing plate precursor is registered on the rotating drum drops and because the printing plate precursor is not in close contact with the circumferential surface of the drum.

SUMMARY OF THE INVENTION

In view of the aforementioned, the present invention has been designed to eliminate slackening of a sheet material (particularly a recording material such as a printing plate precursor) wound around a rotating drum, which slackening is caused when a leading edge and/or a trailing edge of the sheet material is held by a chuck when the sheet material is fed from a direction tangential to the rotating drum and wound around the drum. Thus, objects of the invention are to provide a method for holding a sheet material and to provide an image recording apparatus, wherein the accuracy with which a recording material is registered can be improved and degradation of image quality can be prevented.

A first aspect of the invention is a method for holding a sheet material wound around a circumferential surface of a rotating drum, comprising the steps of: (a) feeding the sheet material to the circumferential surface of the rotating drum from a direction tangential to the circumferential surface of the rotating drum; and (b) nipping at least one of a leading edge and a trailing edge of the fed sheet material between a chuck and the circumferential surface of the rotating drum, wherein, when the sheet material is nipped between the circumferential surface of the rotating drum and the chuck, the sheet material is sequentially nipped from one axial-direction end of the rotating drum to the other axial-direction end of the rotating drum.

Even when the sheet material is wavy, the wavy sheet material can be sequentially flattened out from one axial-direction end of the rotating drum to the other axial-direction end of the rotating drum, due to the chuck sequentially nipping the sheet material from one axial-direction end of the rotating drum to the other axial-direction end of the rotating drum. Therefore, slackness in the sheet material can be eliminated when the nipping is completed.

A second aspect of the invention is an image recording apparatus for recording an image on a sheet-like recording material by relative movement between a rotating drum which includes a circumferential surface, on which the recording material is wound, and a recording section disposed in correspondence to the circumferential surface of the rotating drum, comprising: clamp mechanisms disposed at an area on the circumferential surface of the rotating drum along an axial direction of the rotating drum, each clamp mechanism comprising a chuck that nips a leading edge of the recording material, which is fed from a direction tangential to the circumferential surface of the rotating drum, to the circumferential surface of the rotating drum; a moving mechanism, disposed so as to correspond to the chucks, for selectively moving the chucks into a nipping position, at which the recording material is nipped, or into a nip-release position, at which the recording material is released from being nipped; and a time-difference mechanism for moving the chucks into the nipping position in sequential order from the chuck disposed nearest one axial-direction end of the rotating drum to the chuck disposed nearest the other axial-direction end of the rotating drum.

In the image recording apparatus having the above-described structure, the recording material is fed in the direction tangential to the rotating drum. At this time, the chucks of the clamp mechanisms are set in the nip-release position by the moving mechanism, and the recording material is interposed between the chucks and the circumferential surface of the rotating drum.

When the interposed recording material is registered in a predetermined position, the moving mechanism moves the chucks into the nipping position.

At this time, the moving mechanism does not move the chucks arranged along the axial direction of the rotating drum into the nipping position all at once, but moves the chucks in sequential order into the nipping position from one axial-direction end of the rotating drum to the other axial-direction end of the rotation drum using the time-difference mechanism. In this manner, even when the recording material is wavy, the waviness of the recording material can be sequentially flattened out toward the other end side, whereby slackness in the recording material can be eliminated when the nipping by all of the chucks is completed.

In the second aspect, each clamp mechanism may comprise an urging member for urging the chucks toward the nipping position and a supporting post for supporting the chucks so that the chucks are pivoted by an urging force of the urging member.

The chucks can be rotated by the urging mechanism, with the supporting posts being the fulcrums, to maintain nipping of the recording material. Therefore, the recording material can be reliably held at the time of image recording.

Further, in the second aspect, the image recording apparatus may further comprise trailing edge clamp mechanisms disposed at an area on the circumferential surface of the rotating drum along the axial direction of the rotating drum, each trailing edge clamp mechanism comprising a trailing edge chuck that nips a trailing edge of the recording material, which is fed from a direction tangential to the circumferential surface of the rotating drum, to the circumferential surface of the rotating drum.

After the leading edge of the recording material is nipped by the chucks, the recording material is gradually wound around the circumferential surface of the rotating drum as the rotating drum rotates. Thereafter, the trailing edge of the recording material is also nipped by the trailing edge chucks of the trailing edge clamp mechanisms, whose structure is similar to that of the clamp mechanisms.

Yet in the second aspect, the image recording apparatus may further comprise a trailing edge chuck moving mechanism, disposed so as to correspond to the trailing edge chucks, for selectively moving the trailing edge chucks into the nipping position or into the nip-release position.

Still in the second aspect, the image recording apparatus may further comprise a time-difference mechanism for moving the trailing edge chucks into the nipping position in sequential order from the trailing edge chuck disposed nearest one axial-direction end of the rotating drum to the trailing edge chuck disposed nearest the other axial-direction end of the rotating drum.

Because the trailing edge chucks also sequentially nip the trailing edge of the recording material from one axial-direction end of the rotating drum to the other axial-direction end of the rotating drum, slackness in the recording material can be further eliminated.

DESCRIPTION OF THE PREFERRED EMBODIMENT

Figure 1:
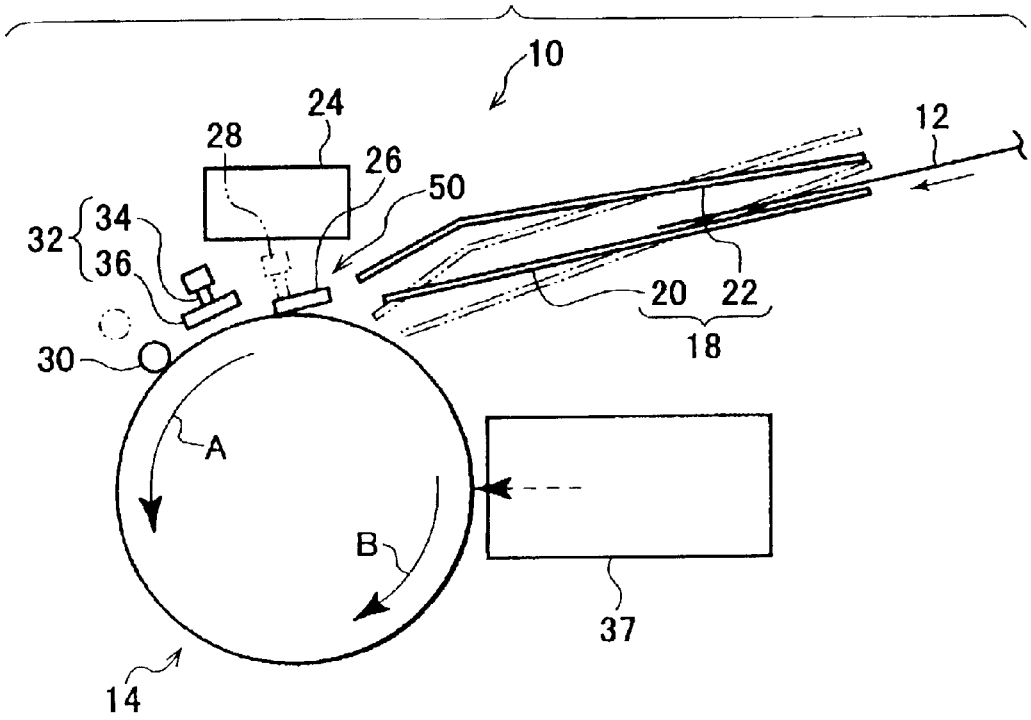
FIG. 1 is a schematic view showing an automatic printing plate exposure apparatus according to an embodiment of the present invention.

FIG. 1 shows an automatic printing plate exposure apparatus 10 according to an embodiment of the present invention.

The automatic printing plate exposure apparatus 10 comprises two sections: an exposure section 14 for exposing an image onto an image forming layer of a printing plate precursor 12 by irradiating the image forming layer with a light beam; and a conveyance guide unit 18 for conveying the printing plate precursor 12 toward the exposure section 14. After being exposed in the automatic printing plate exposure apparatus 10, the printing plate precursor 12 is fed to a developing apparatus (not shown) disposed next to the automatic printing plate exposure apparatus 10.

The exposure section 14 includes, as a main component, a rotating drum 16 that has a circumferential surface around which the printing plate precursor 12 is wound and held. The printing plate precursor 12 is guided by the conveyance guide unit 18 and is fed onto the rotating drum 16 along a direction tangential to the rotating drum 16. The conveyance guide unit 18 comprises a plate-feed guide 20 and a plate-eject guide 22.

The plate-feed guide 20 and the plate-eject guide 22 of the conveyance guide unit 18 are disposed so that they have a substantially V-shaped positional relationship relative to each other, and pivot at a predetermined angle on an axis in the vicinity of the center of FIG. 1. With this rotation, the plate-feed guide 20 or the plate-eject guide 22 can be selectively positioned along a direction tangential to the rotating drum 16.

A puncher 24 is disposed in the vicinity of the conveyance guide unit 18. When the plate-feed guide 20 is positioned to face the puncher 24, the leading edge of the printing plate precursor 12 can be fed into the puncher 24. That is, first, the printing plate precursor 12 is guided by the plate-feed guide 20 to the puncher 24 so that a registration notch is formed in the leading edge of the printing plate precursor 12. After the notch is formed, the printing plate precursor 12 is carried back to the plate-feed guide 20. Then, the conveyance guide unit 18 is rotated to bring the printing plate precursor 12 to a position corresponding to a direction tangential to the rotating drum 16.

The rotating drum 16 is rotated by a driving device (not shown) in a direction in which the printing plate precursor 12 is set on the rotating drum 16 and exposed (i.e., the direction of arrow A in FIG. 1) and in a direction in which the printing plate precursor 12 is removed from the rotating drum 16 (i.e., the direction of arrow B in FIG. 1), opposite to the setting/exposing direction.

As shown in FIG. 1, leading edge clamp mechanisms 50 are attached at predetermined positions on the outer circumferential surface of the rotating drum 16. When the printing plate precursor 12 is set on the rotating drum 16, rotation of the rotating drum 16 is stopped at a position where the leading edge clamp mechanisms 50 face the leading edge of the printing plate precursor 12 being fed onto the rotating drum 16 by the plate-feed guide 20 of the conveyance guide unit 18.

Figure 3:
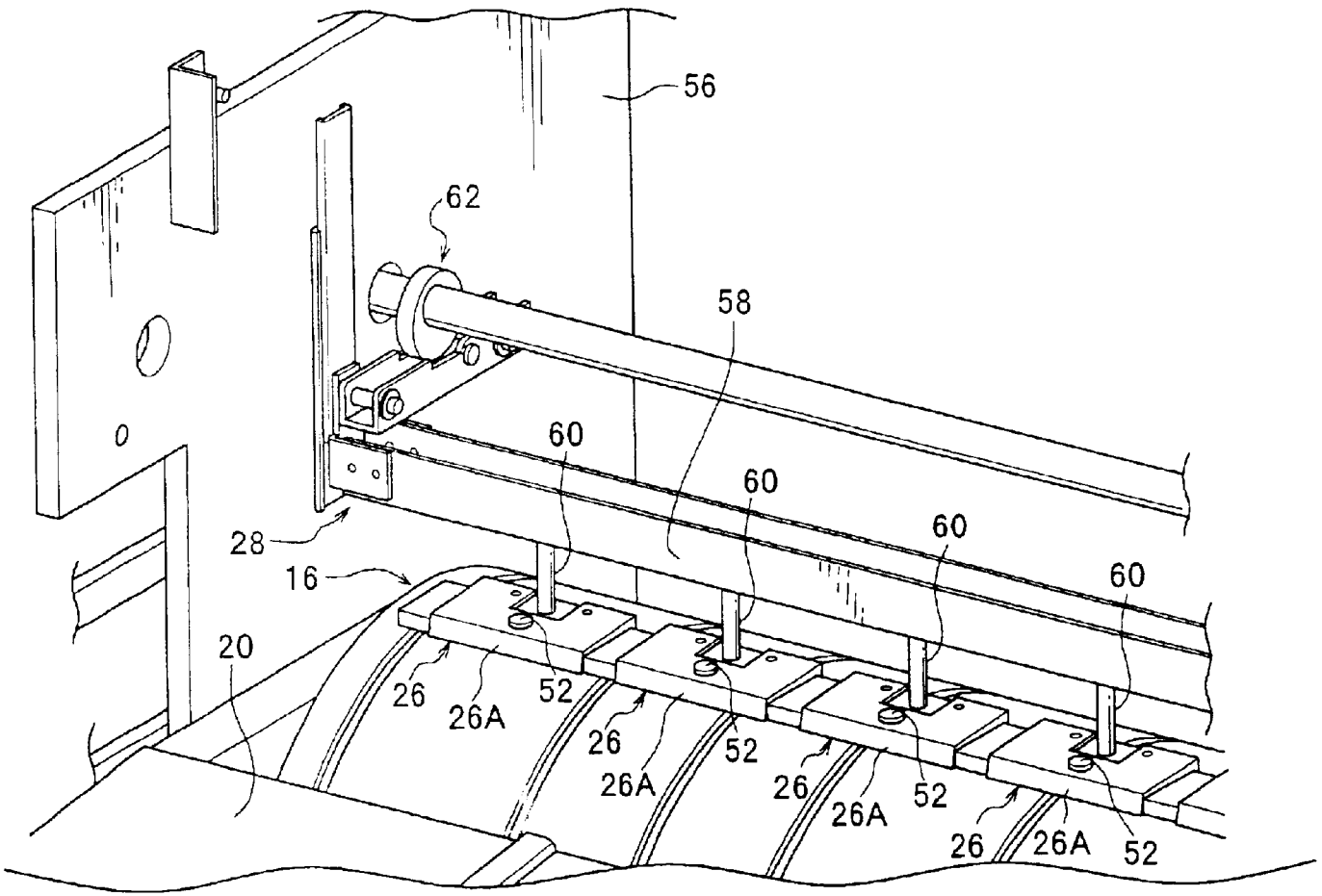
FIG. 3 is a perspective view showing a chuck opening/closing unit disposed above a rotating drum, and surrounding portions thereof.

The leading edge clamp mechanisms 50 are arranged in a line along the axial direction of the rotating drum 16 (see FIGS. 3 and 4). It should be noted that each of the leading edge clamp mechanisms 50 can operate independently.

Figure 2:
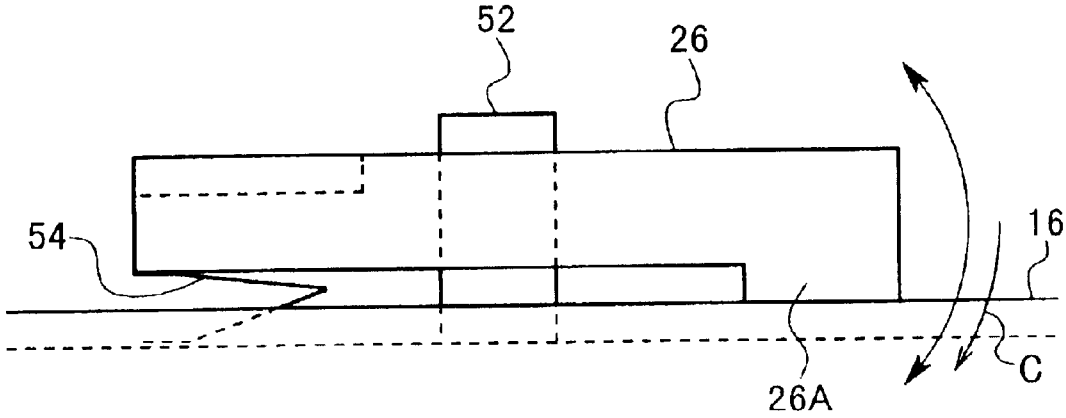
FIG. 2 is a side view showing a leading edge clamp mechanism.

As shown in FIG. 2, each of the leading edge clamp mechanisms 50 includes a leading edge chuck 26 for nipping the printing plate precursor 12 between the leading edge chuck 26 and the circumferential surface of the rotating drum 16. A long edge of the leading edge chuck 26 forms a pressing portion 26A for pressing the printing plate precursor 12 against the rotating drum 16.

The leading edge chuck 26 is supported by a supporting post 52 attached to the rotating drum 16.

The supporting post 52 is positioned, with respect to the circumferential direction of the rotating drum 16, nearer to the long side of the leading edge clamp 50 disposed with the clamping portion 26A than to the other long side of the leading end clamp 50. Using the rotary shaft 52A of the column 52 as a fulcrum, the clamp body 26 can pivot like a seesaw.

A plate spring 54 is interposed, as an urging member, between the circumferential surface of the rotating drum 16 and a portion of the leading edge chuck 26 at a side opposite to the pressing portion 26A with respect to the supporting post 52. The plate spring 54 urges the pressing portion 26A of the leading edge chuck 26 toward the circumferential surface of the rotating drum 16.

In other words, the leading edge of the printing plate precursor 12 fed from a direction tangential to the rotating drum 16 and positioned between the pressing portion 26A and the circumferential surface of the rotating drum 16 can be nipped (i.e., in the direction of arrow C in FIG. 2).

As shown in FIGS. 3 and 4, a chuck opening/closing unit 28, which serves as a moving mechanism, is disposed above the rotating drum 16 so as to face the leading edge chucks 26.

The chuck opening/closing unit 28 is disposed so as to span the distance between a pair of side plates 56, which rotatably support both ends of a rotating shaft of the rotating drum 16.

The chuck opening/closing unit 28 comprises an reciprocating block 58, which is attached to the side plates 56 so as to be movable toward and away from the rotating drum 16, and pressing shafts 60 attached to the reciprocating block 58 and arranged so as to respectively correspond to the leading edge clamp mechanisms 50.

The reciprocating block 58 is connected at both ends in a longitudinal direction thereof (i.e., the axial direction of the rotating drum 16) to a driving mechanism 62. Driven by the driving mechanism 62, the reciprocating block 58 moves up and down while maintaining a parallel positional relationship with the rotating drum 16.

Figure 4A:
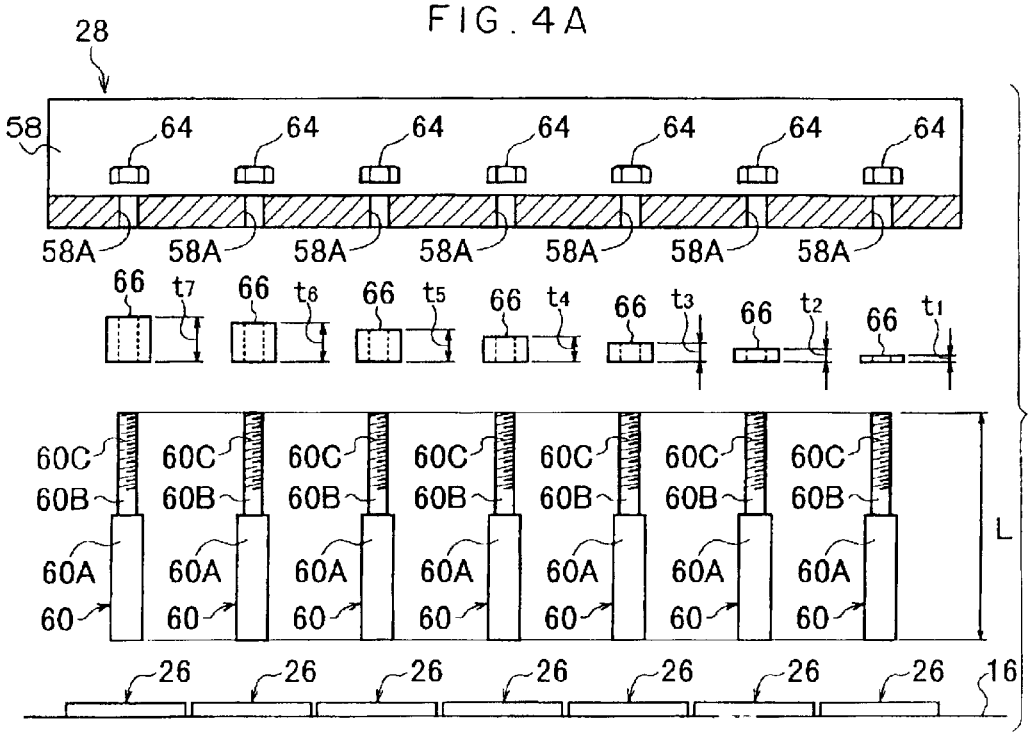
FIG. 4A is a front view for illustrating how a reciprocating plate and pressing shafts are assembled, showing a state prior to being assembled.
Figure 4B:
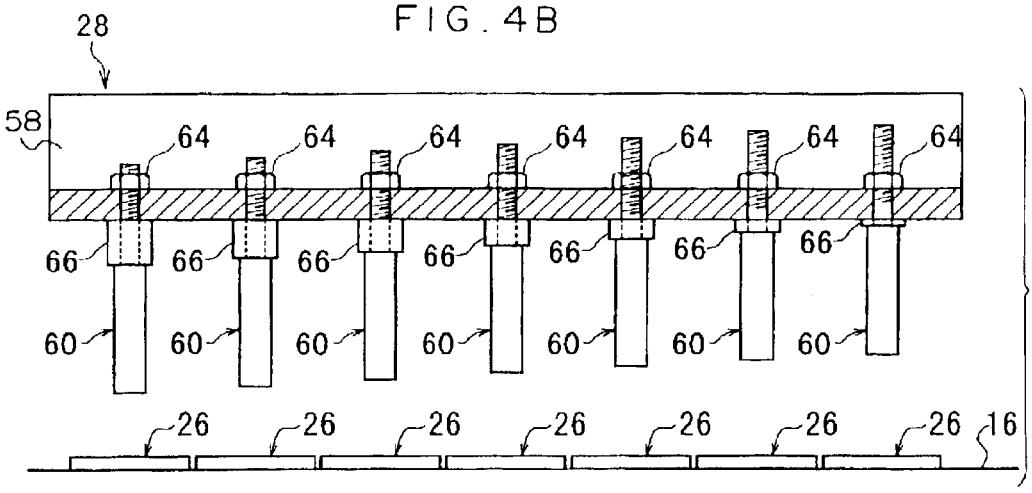
FIG. 4B is a front view for illustrating how the reciprocating plate and the pressing shafts are assembled, showing a state in which they are assembled.

As shown in FIGS. 4A and 4B, all of the pressing shafts 60 have the same axial-directional dimension L, and have a stepped form including a large diameter portion 60A and a small diameter portion 60B. In the state shown in FIG. 4A, the small diameter portions 60B face the reciprocating block 58. It should be noted that the large diameter portions 60A have the same axial-direction dimension, and the small diameter portions 60B also have the same axial-direction dimension.

The reciprocating block 58 is provided with through holes 58A, in which the small diameter portions 60B are inserted. The small diameter portions 60B extend through the through holes 58A and project from an upper surface of the reciprocating block 58.

Each of the small diameter portions 60B is provided with a male screw 60C, at least at a portion which projects from the upper surface of the reciprocating block 58. The pressing shafts 60 can be fixed to the reciprocating block 58 with nuts 64 screwed on the male screws 60C.

Further, disk-shaped shims 66 having mutually different thicknesses $t_n(t_1<t_2<t_3< \ldots <t_n)$ are interposed at base portions of the small diameter portions 60B (border portions between the small diameter portions 60B and the large diameter portions 60A).

The shims 66 are disposed at the small diameter portions 60B of the pressing shafts 60 in such a manner that the thickness of the shims 66 gradually increases from one end to the other end of the rotating drum 16.

Therefore, although all of the pressing shafts 60 have the same form, the ends of the large diameter portions 60A are positioned at mutually different levels when the pressing shafts 60 are fixed to the reciprocating block 58.

In other words, when the reciprocating block 58 is at an uppermost position, distances from the ends of the large diameter portions 60A of the pressing shafts 60 to the circumferential surface of the rotating drum 16 gradually decrease from one end to the other end of the rotating drum 16.

When the reciprocating block 58 is moved down, the pressing shaft 60 nearest one axial-direction end of the rotating drum 16 is the first to abut against the corresponding leading edge chuck 26 to move it into a nip-release position, and the pressing shaft 60 nearest the other axial-direction end of the rotating drum 16 is the last to abut against the corresponding leading edge chuck 26 to move it into the nip-release position.

In other words, when the leading edge chucks 26 are brought into respective nipping positions (i.e., when the reciprocating block 58 is moved upward), the leading edge chuck 26 nearest one axial-direction end of the rotating drum 16 is the first to be brought into the nipping position, and the leading edge chuck 26 nearest the other axial-direction end of the rotating drum 16 is the last to be brought into the nipping position, with intervening leading edge chucks 26 being sequentially brought into the nipping position so that nipping is sequentially effected along the axial direction of the rotating drum 16.

Because the leading edge chucks 26 sequentially nip the printing plate precursor 12 from one axial-direction end of the rotating drum 16 to the other axial-direction end of the rotating drum 16, waves in the printing plate precursor 12 are sequentially flattened out in the axial direction. Therefore, when the leading edge of the printing plate precursor 12 is fully nipped, there is no slackness in the leading edge of the printing plate precursor 12.

When the reciprocating block 58 is moved down and the leading edge chucks 26 are brought into the nip-release position, the printing plate precursor 12 can be interposed between the leading edge chucks 26 and the circumferential surface of the rotating drum 16.

At this time, the printing plate precursor 12 abuts on a registration pin (not shown), which is disposed so as to project from a predetermined position on the circumferential surface of the rotating drum 16, and is registered with respect to the rotating drum 16.

When the printing plate precursor 12 is registered, the driving mechanism 62 drives the reciprocating block 58 to move it upward, and the leading edge of the printing plate precursor 12 is nipped and held between the leading edge chucks 26 and the circumferential surface of the rotating drum 16.

As shown in FIG. 1, when the leading edge of the printing plate precursor 12 is fastened to the rotating drum 16, the rotating drum 16 is rotated in the setting/exposing direction. Thus, the printing plate precursor 12 fed from the plate-feed guide 20 of the conveyance guide unit 18 is wound around the circumferential surface of the rotating drum 16.

A squeeze roller 30 is disposed in the vicinity of the circumferential surface of the rotating drum 16 downstream in the setting/exposing direction from a position where the leading edge of the printing plate precursor 12 is nipped. The squeeze roller 30 moves toward the rotating drum 16 to press the printing plate precursor 12 being wound around the rotating drum 16 against the rotating drum 16, so that the printing plate precursor 12 closely contacts the rotating drum 16.

Further, a trailing edge chuck attaching/detaching unit 32 is disposed in the vicinity of the rotating drum 16 upstream in the setting/exposing direction from the squeeze roller 30. The trailing edge chuck attaching/detaching unit 32 includes trailing edge chucks 36 attached at tips of shafts 34 that project toward the rotating drum 16.

When the trailing edge of the printing plate precursor 12 wound around the rotating drum 16 faces the trailing edge chuck attaching/detaching unit 32, the shafts 34 are further projected toward the rotating drum 16 to set the trailing edge chucks 36 at predetermined positions on the rotating drum 16. In this manner, the trailing edge of the printing plate precursor 12 is nipped and held between the trailing edge chucks 36 and the rotating drum 16.

When both the leading edge and the trailing edge of the printing plate precursor 12 are held on the rotating drum 16, the squeeze roller 30 is moved away from the rotating drum 16. Then, while the rotating drum 16 is rotated at a predetermined high speed, a light beam modulated on the basis of image data is irradiated from a recording head 37 synchronously with the rotation of the rotating drum 16. Thus, the printing plate precursor 12 is scan-exposed on the basis of image data.

When scan-exposure of the printing plate precursor 12 is completed, the rotation of the rotating drum 16 is stopped at a position where the trailing edge chucks 36 holding the trailing edge of the printing plate precursor 12 face the trailing edge chuck attaching/detaching unit 32, and the trailing edge chucks 36 are detached from the rotating drum 16. Thus, the trailing edge of the printing plate precursor 12 is released.

Subsequently, by rotating the rotating drum 16 in the direction in which the printing plate precursor 12 is ejected, the printing plate precursor 12 is ejected trailing edge first along a direction tangential to the rotating drum 16 onto the plate-eject guide 22 of the conveyance guide unit 18, and the printing plate precursor 12 is then conveyed to a developing apparatus for further processing.

Next, operation of this embodiment is described.

After the printing plate precursor 12 is fed onto the plate-feed guide 20 of the conveyance guide unit 18, if it is necessary to punch the printing plate precursor 12, the conveyance guide unit 18 is moved (pivoted) so that the plate-feed guide 20 guides the printing plate precursor 12 to the puncher 24.

At the puncher 24, the leading edge of the printing plate precursor 12 is subjected to predetermined punching. Then, the printing plate precursor 12 is returned to the plate-feed guide 20 and is temporarily registered.

When exposure is performed, the conveyance guide unit 18 is moved (pivoted) so that plate-feed guide 20 guides the printing plate precursor 12 to the rotating drum 16. Thus, the printing plate precursor 12 can be fed onto the rotating drum 16 along a direction tangential to the rotating drum 16.

The printing plate precursor 12 fed onto the rotating drum 16 is wound closely around the circumferential surface of the rotating drum 16 and nipped by the leading edge chucks 26 and the trailing edge chucks 36, and is thus registered for exposure.

A fastening procedure for fastening the leading edge of the printing plate precursor 12 with the leading edge chucks 26 will now be explained.

When the rotating drum 16 is standing by in a predetermined position for receiving the printing plate precursor 12, the leading edge clamp mechanisms 50 face the reciprocating block 58.

At this time, the reciprocating block 58 is positioned in a lowermost position by a driving force from the driving mechanism 62. As a result, the pressing shafts 60 press the leading edge chucks 26 to pivot the leading edge chucks 26 counter to an urging force from the plate springs 54, with the supporting posts 52 being the fulcrums. In this pivoted state, the pressing portions 26A are separated from the circumferential surface of the rotating drum 16, and a space is formed therebetween for receiving the printing plate precursor 12.

When the printing plate precursor 12 enters the space and is registered in a predetermined position, the reciprocating block 58 starts to rise (moves away from the rotating drum 16) by the driving force from the driving mechanism 62.

In this embodiment, the shims 66 having mutually different thicknesses are disposed at the small diameter portions 60B of the pressing shafts 60. Therefore, distances between the ends of the pressing shafts 60 and the circumferential surface of the rotating drum 16 are thus made different from each other such that the distance gradually decreases from one axial-direction end of the rotating drum 16 to the other axial-direction end of the rotating drum 16.

Therefore, when the reciprocating block 58 starts to rise, the pressing shaft 60 disposed nearest one axial-direction end of the rotating drum 16 stops abutting against the corresponding leading edge chuck 26, whereby the corresponding portion of the printing plate precursor 12 is nipped between that leading edge chuck 26 and the circumferential surface of the rotating drum 16.

Therefore, the leading edge of the printing plate precursor 12 is sequentially nipped with a time difference toward the other axial-direction end of the rotating drum 16.

If the printing plate precursor 12 is wavy along the axial direction of the rotating drum 16, areas of the printing plate precursor 12 other than those being flattened by being nipped are slack. In this case, since the slackness is sequentially eliminated from one axial-direction end of the rotating drum 16 to the other axial-direction end of the rotating drum 16 in this embodiment, the slackness is finally eliminated at the other axial-direction end of the rotating drum 16 and flatness can be maintained across all areas of the printing plate precursor 12.

It should be noted that, although explanation has not been given in this embodiment, flatness can also be maintained at the trailing edge of the printing plate precursor 12 through a similar procedure using the trailing edge chucks 36.

Once the printing plate precursor 12 has been wound around and is held on the rotating drum 16, image data is read and exposure with a light beam from the recording head 37 is started. The exposure is a so-called scan-exposure that is effected by moving the recording head 37 in the axial direction of the rotating drum 16 (sub-scanning) while the rotating drum 16 is rotated at a high speed (main-scanning).

When the exposure is completed, the conveyance guide unit 18 is moved to dispose the plate-eject guide 22 in a position of correspondence with the rotating drum 16, and the printing plate precursor 12 wound around the rotating drum 16 is ejected along a direction tangential to the rotating drum 16. At this time, the printing plate precursor 12 is sent to the plate-eject guide 22.

When the printing plate precursor 12 is sent to the plate-eject guide 22, the conveyance guide unit 18 is moved to dispose the plate-eject guide 22 in a position of correspondence with an ejecting port, and the printing plate precursor 12 is ejected from the exposure section 14. A developing section is provided near the ejecting port, and the printing plate precursor 12 is subsequently developed.

According to this embodiment, in order to nip the printing plate precursor 12, which is fed along a direction tangential to the rotating drum 16, between the circumferential surface of the rotating drum 16 and leading edge chucks 26 arranged in a line along the axial direction of the rotating drum 16, the reciprocating block 58 is moved upward to allow the leading edge chucks 26, which have been set in a nip-release state by the pressing shafts 60, to be pivoted by the urging force from the plate springs 52 with the supporting posts 52 being the fulcrums.

Since the shims 66 having mutually different thicknesses are disposed at the small diameter portions 60B of the pressing shafts 60, nipping by the leading edge chucks 26 can be effected with a time difference.

As a result, the printing plate precursor 12 is sequentially nipped from one end to the other in the width direction of the printing plate precursor 12 (i.e., from one axial-direction end of the rotating drum 16 to the other axial-direction end of the rotating drum 16), whereby waves in the printing plate precursor 12 can be sequentially flattened out. Thus, when the printing plate precursor 12 is nipped, flatness of the printing plate precursor 12 is maintained. This improves the precision with which the printing plate precursor 12 is registered, and prevents degradation of image quality caused by changes in depth of focus, or the like, at the time of imagewise exposure due to the printing plate precursor 12 not being in close contact with the circumferential surface of the rotating drum 16.

As described above, the invention eliminates slackness in a sheet material (particularly, a printing plate precursor), which slackness is likely caused when a leading edge and/or a trailing edge of the sheet material, which is fed in a direction tangential to a rotating drum to be wound around the drum, is held with chucks. Therefore, the invention is very effective in improving the precision with which the sheet material is registered and preventing degradation of image quality.

What is claimed is:

1. A method for holding a sheet material wound around a circumferential surface of a rotating drum, comprising the steps of:

(a) feeding the sheet material to the circumferential surface of the rotating drum from a direction tangential to the circumferential surface of the rotating drum; and (b) nipping at least one of a leading edge and a trailing edge of the fed sheet material between a plurality of chucks arranged in a line along an axial direction of the rotation drum and the circumferential surface of the rotation drum, wherein, when the sheet material is nipped between the circumferential surface of the rotating drum and the plurality of chucks, the sheet material is sequentially nipped from one axial-direction end of the rotating drum to the other axial-direction end of the rotating drum.

2. A method for holding a sheet material according to claim 1, further comprising, prior to step (a), punching the leading edge of the sheet material.

3. A method for holding a sheet material according to claim 1, wherein the sheet material is sequentially nipped from one chuck of the plurality of chucks at one axial-direction end of the rotating drum to another chuck of the plurality of chucks at the other axial-direction end of the rotating drum.

4. An image recording apparatus for recording an image on a sheet-like recording material by relative movement between a rotating drum which includes a circumferential surface, on which the recording material is wound, and a recording section disposed in correspondence to the circumferential surface of the rotating drum, comprising:

clamp mechanisms disposed at an area on the circumferential surface of the rotating drum along an axial direction of the rotating drum, each clamp mechanism comprising a chuck that nips a leading edge of the recording material, which is fed from a direction tangential to the circumferential surface of the rotating drum, to the circumferential surface of the rotating drum;

a moving mechanism, disposed so as to correspond to the chucks, for selectively moving the chucks into a nipping position, at which the recording material is nipped, or into a nip-release position, at which the recording material is released from being nipped; and a time-difference mechanism for moving the chucks into the nipping position in sequential order from the chuck disposed nearest one axial-direction end of the rotating drum to the chuck disposed nearest the other axial-direction end of the rotating drum.

5. An image recording apparatus according to claim 4, wherein each clamp mechanism comprises an urging member for urging the chucks toward the nipping position and a supporting post for supporting the chucks so that the chucks are pivoted by an urging force of the urging member.

6. An image recording apparatus according to claim 5, wherein the moving mechanism moves the chucks into the nipping position or into the nip-release position by pivoting the chucks.

7. An image recording apparatus according to claim 6, wherein the moving mechanism comprises pressing shafts respectively corresponding to the chucks.

8. An image recording apparatus according to claim 7, wherein the moving mechanism comprises a reciprocating member for fixing the pressing shafts in the axial direction of the rotating drum and moving the pressing shafts downward and upward so that the pressing shafts move toward and away from the respectively corresponding chucks.

9. An image recording apparatus according to claim 8, wherein the reciprocating member moves the pressing shafts all at once.

10. An image recording apparatus according to claim 9, wherein all of the pressing shafts have the same length.

11. An image recording apparatus according to claim 10, wherein the time-difference mechanism is disposed between the reciprocating member and the pressing shafts.

12. An image recording apparatus according to claim 11, wherein the time-difference mechanism comprises shims having mutually different thicknesses.

13. An image recording apparatus according to claim 12, wherein the shims are disposed such that the thinnest shim is disposed at one axial-direction end of the rotating drum, and the thickness gradually increases toward the other axial-direction end of the rotating drum.

14. An image recording apparatus according to claim 6, further comprising trailing edge clamp mechanisms disposed at an area on the circumferential surface of the rotating drum along the axial direction of the rotating drum, each trailing edge clamp mechanism comprising a trailing edge chuck that nips a trailing edge of the recording material, which is fed from a direction tangential to the circumferential surface of the rotating drum, to the circumferential surface of the rotating drum.

15. An image recording apparatus according to claim 14, further comprising a trailing edge chuck moving mechanism, disposed so as to correspond to the trailing edge chucks, for selectively moving the trailing edge chucks into the nipping position or into the nip-release position.

16. An image recording apparatus according to claim 15, further comprising a time-difference mechanism for moving the trailing edge chucks into the nipping position in sequential order from the trailing edge chuck disposed nearest one axial-direction end of the rotating drum to the trailing edge chuck disposed nearest the other axial-direction end of the rotating drum.

17. An image recording apparatus according to claim 16, wherein each trailing edge clamp mechanism comprises an urging member for urging the trailing edge chucks into the nipping position and a supporting post for supporting the trailing edge chucks so that the trailing edge chucks are pivoted by an urging force from the urging member.

18. A method for holding a sheet material wound around a circumferential surface of a rotating drum, comprising the steps of:

(a) feeding the sheet material to the circumferential surface of the rotating drum from a direction tangential to the circumferential surface of the rotating drum; and (b) nipping at least one of a leading edge and a trailing edge of the fed sheet material between a plurality of chucks and the circumferential surface of the rotating drum, wherein, when the sheet material is nipped between the circumferential surface of the rotating drum and the plurality of chucks, predetermined lengths of the sheet material are sequentially nipped from one axial-direction end of the rotating drum to the other axial-direction end of the rotating drum.

19. A method for holding a sheet material according to claim 18, wherein each of the predetermined lengths correspond to a respective chuck of the plurality of chucks.

20. A method for holding a sheet material according to claim 19, wherein the plurality of chucks are substantially aligned on a line along the axial direction of the rotating drum.

21. An image recording apparatus for holding a sheet of material wound around a surface of a rotating drum and recording an image on the sheet of material, comprising:

a plurality of clamp mechanisms including chucks disposed on the rotating drum;

a moving mechanism for moving the chucks into a nipping position or into a nip-release position; and a time-difference mechanism for moving the chucks into the nipping position in sequential order from the chuck disposed nearest one axial-direction end of the rotating drum to the chuck disposed nearest the other axial-direction end of the rotating drum.

22. An image recording apparatus according to claim 21, wherein the plurality of clamp mechanisms are substantially disposed along a line in the axial direction of the rotating drum and the moving mechanism is disposed so as to correspond to each of the chucks.

* * * * *